US007185373B2

(12) United States Patent
Chiang

(10) Patent No.: US 7,185,373 B2
(45) Date of Patent: Mar. 6, 2007

(54) SWIMMING GOGGLES

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 0 days.

(21) Appl. No.: 11/267,502

(22) Filed: Nov. 7, 2005

(65) Prior Publication Data

US 2006/0059607 A1 Mar. 23, 2006

Related U.S. Application Data

(63) Continuation-in-part of application No. 10/420,852, filed on Apr. 23, 2003, now Pat. No. 6,961,965.

(51) Int. Cl.
*A61F 9/02* (2006.01)

(52) U.S. Cl. ..... 2/445; 2/452

(58) Field of Classification Search ..... 2/428, 2/430, 440, 450, 452
See application file for complete search history.

(56) References Cited

U.S. PATENT DOCUMENTS 6,832,394 B1 * 12/2004 Chiang ..... 2/428
6,961,965 B2 * 11/2005 Chiang ..... 2/445
7,007,311 B2 * 3/2006 Chiang ..... 2/448
7,020,904 B2 * 4/2006 Chiang ..... 2/442
7,020,905 B2 * 4/2006 Chiang ..... 2/448
7,055,182 B2 * 6/2006 Chiang ..... 2/450

* cited by examiner

*Primary Examiner*—Katherine Moran
(74) *Attorney, Agent, or Firm*—Troxell Law Office PLLC

(57) ABSTRACT

A pair of swimming goggles, includes a left and a right goggle frame, wherein a connection bridge connected therebetween, a pair of buckles respectively attached to the left and the right goggle frames, and a head strap adjustably fastened to the buckles. Each buckle includes a base, a cover, a shaft and a fastener, wherein the fastener includes a handle and an engagement protrusion. a tongue integrally extends from a side of the handle and can be leaned against the left and the right goggle frame after assembly. When the swimming goggles is worn on a user's head, it is very convenient to use the swimming goggles of the present invention whenever one needs adjusting an appropriate wearing position.

10 Claims, 5 Drawing Sheets

SWIMMING GOGGLES

The present invention relates to a pair of swimming goggles and is a Continuation In Part application of U.S. patent application Ser. No. 10/420,852, now U.S. Pat. No. 6,961,965, filed Apr. 23, 2003 that improve a handle of a buckle of the present invention can return position automatically after an adjustment of a head strap.

BACKGROUND OF THE INVENTION

1. Field of the Invention
2. Related Art

Swimming goggles are worn with a head strap thereof being fastened to a user's head. The head strap is usually adjustable to be tight or loose to the user's head thereby making the user comfortable. However, the swimming goggles must be taken off before the adjustment of the head strap. Then the swimming goggles are worn again after the adjustment of the head strap. It is inconvenient to adjust the swimming goggles.

The inventor of the present invention had overcome the aforementioned drawbacks in U.S. patent application Ser. No. 10/420,852, that is, through a fastener including a handle and an engagement protrusion and by way of pressing the handle toward a free end of a head strap to make the engagement protrusion engaging against the head strap, thereby to position the head strap. In this way, the user does not need to take off the swimming goggles to adjust the head strap but only has to draw the free end of the head strap backwardly for tightening or, to press the handle in an inverse direction to disengage the engagement protrusion thereby can loosen the head strap.

However, the prior invention applies to practical use still involved somewhere can be improved. The inventor therefore makes further improvements on U.S. patent application Ser. No. 10/420,852 for a better and convenient use.

SUMMARY OF THE INVENTION

Accordingly, an object of the present invention is to provide a pair of swimming goggles of which a handle can return position automatically after an adjustment of a head strap for serving a convenient and simple use.

To achieve the above-mentioned object, a pair of swimming goggles in accordance with the present invention includes a left and a right goggle frame, wherein a connection bridge connected therebetween, a pair of buckles respectively attached to the left and the right goggle frames, and a head strap adjustably fastened to the buckles. Each buckle includes a base, a cover, a shaft and a fastener, wherein the fastener includes a handle and an engagement protrusion. The feature of the present invention is a tongue integrally extends from a side of the handle and can be leaned against the left and the right goggle frame after assembly. When the swimming goggles is worn on a user's head, the user can push the handle outwardly and then move the swimming goggles ahead of the user's eyes, thus the head strap is loosened. When cease pushing the handle, the tongue will return position automatically. To tight the head strap, only has to draw the free end of the head strap backwardly Other objects, advantages and novel features of the present invention will be drawn from the following detailed embodiment of the present invention with attached drawings, in which:

DESCRIPTION OF THE PREFERRED EMBODIMENTS

Figure 1:
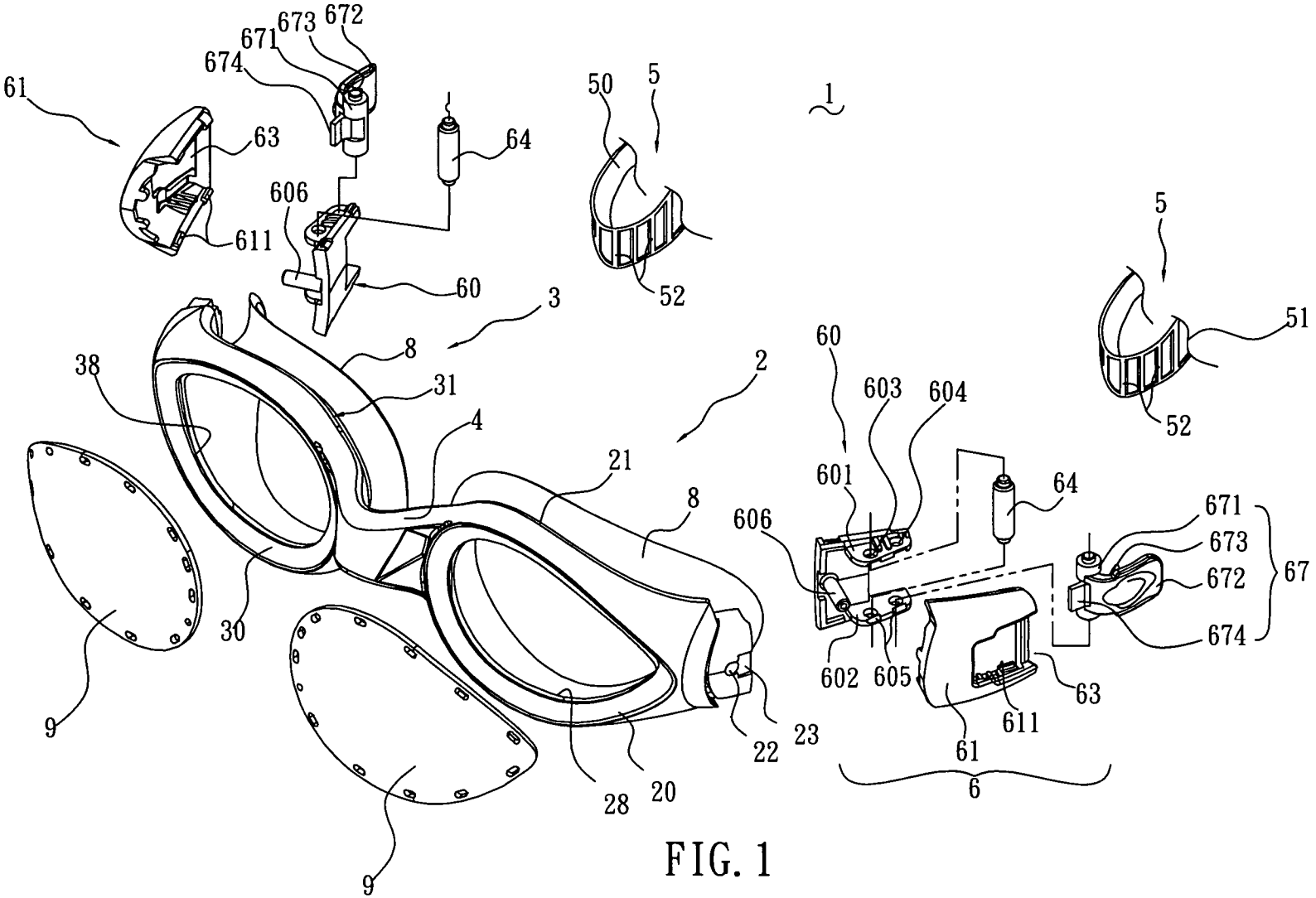
FIG. 1 is an exploded perspective view of a pair of swimming goggles of the present invention.
Figure 2:
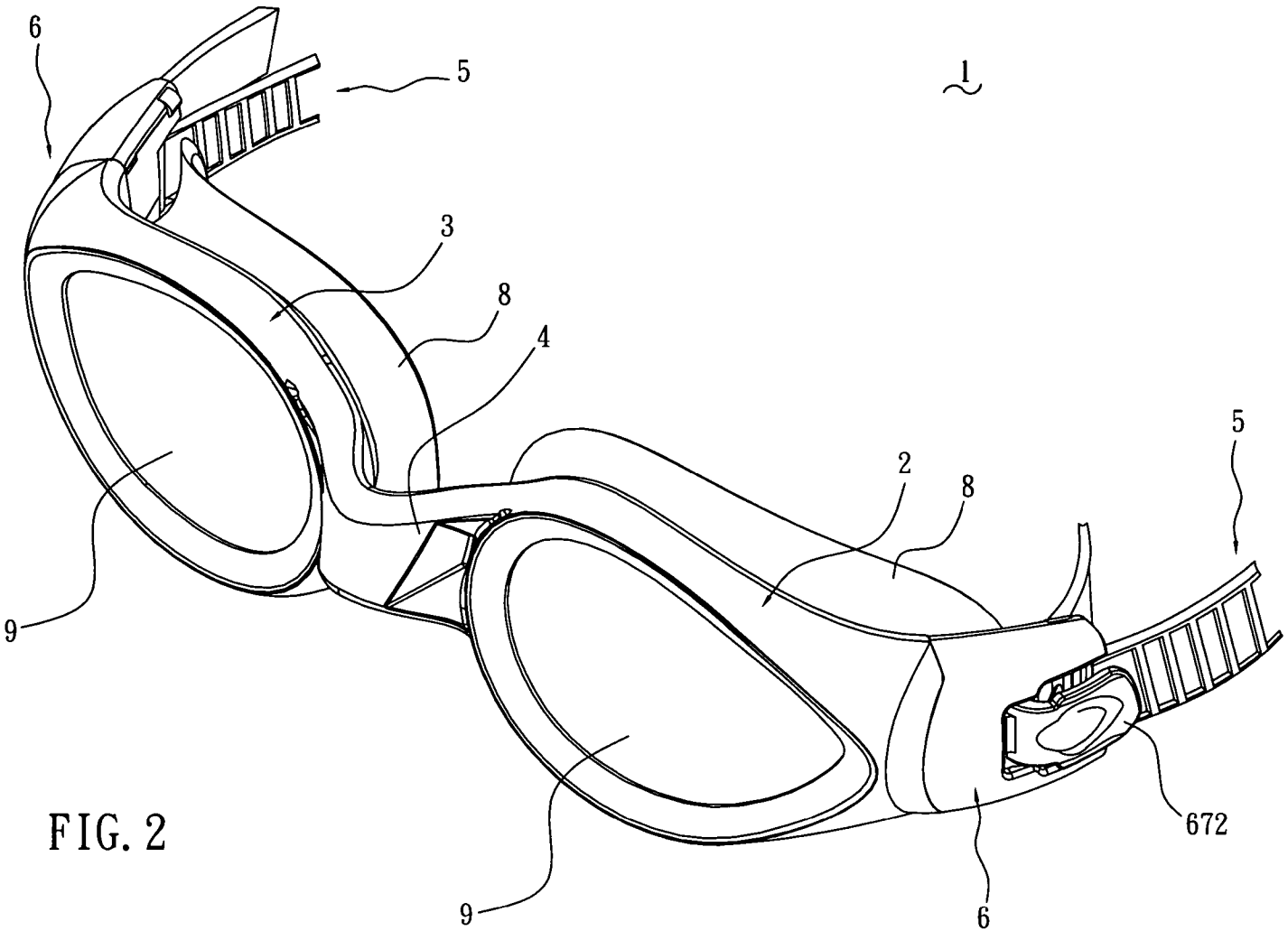
FIG. 2 is an assembled view of FIG. 1.
Figure 3:
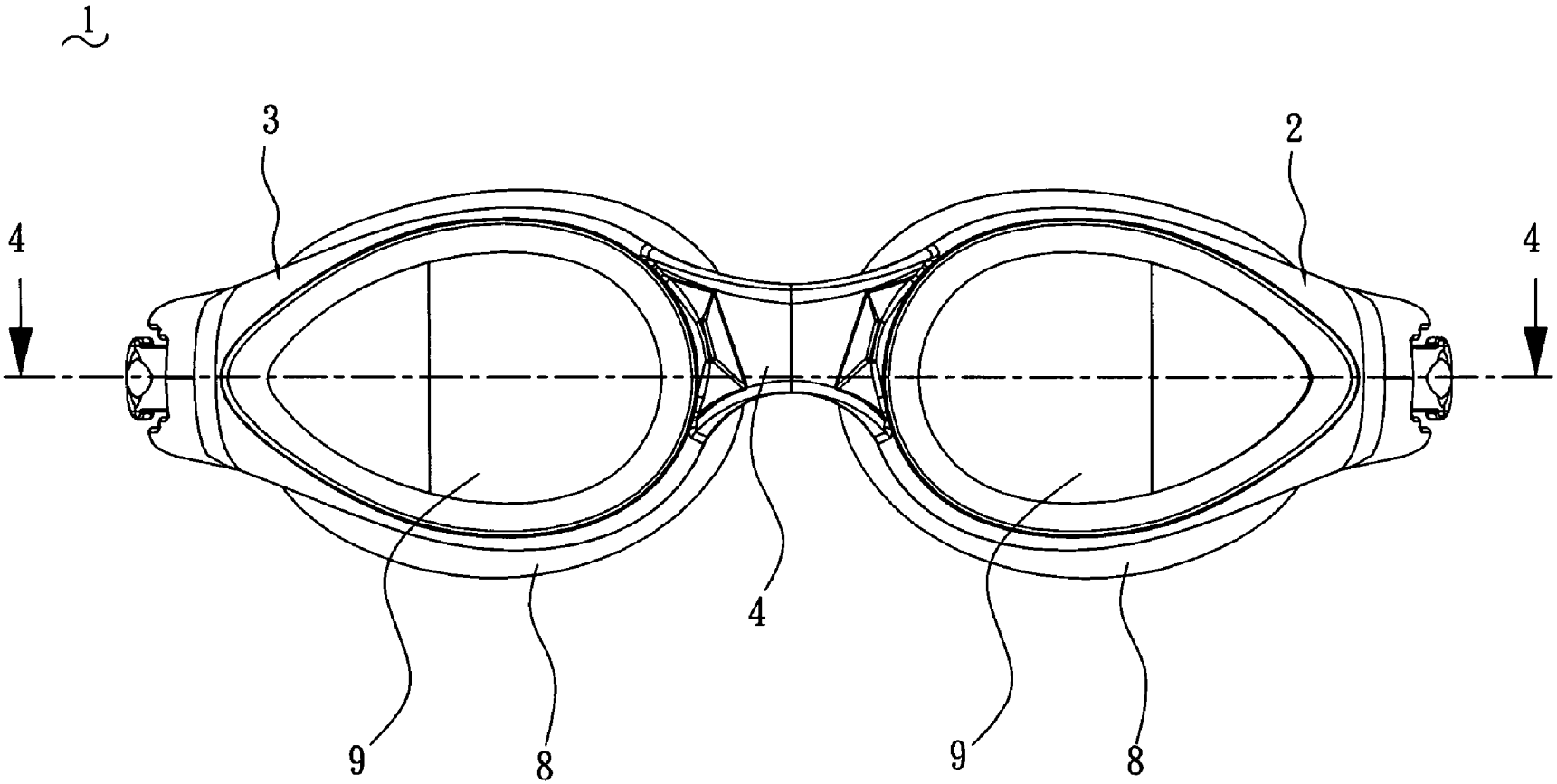
FIG. 3 is a front elevational view of FIG. 2.

Referring to FIG. 1, a pair of swimming goggles 1 of the present invention includes a left goggle frame 2, a right goggle frame 3, a connection bridge 4, a head strap 5, and a pair of adjustable buckles 6. Each of the left and the right goggle frames 2, 3 has an outer surface 20, 30 and an inner surface 21, 31. A pair of receiving grooves 28, 38 are defined between the outer surfaces 20, 30 and the inner surfaces 21, 31 for receive lenses 9 therein, respectively. A pair of protection pads 8 are integrally formed at the inner surfaces 21, 31 of the left and the right goggle frame 2, 3 for comfortable contact with a user's face. Assembled holes 22, 32 are respectively located on outer sides of the left and the right goggle frame 2, 3. Furthermore, concavities 23, 33 are located close to the assembled holes 22, 32 respectively. The connection bridge 4 is connected between and unitarily forms with the left and the right goggle frame 2, 3.

A pair of buckles 6 is respectively fastened to the assembled holes 22, 32. Each buckle 6 includes a base 60, a cover 61, a shaft 64 and a fastener 67. The base 60 includes an upper wall 601 substantially perpendicularly extending from an upper portion thereof, and a lower wall 602 substantially perpendicularly extending from a lower portion thereof. A pair of first axial holes 603 and second axial holes 604 are defined in the upper and lower walls 601, 602, respectively. A pair of recesses 605 is defined in the upper and lower walls 601, 602, and a pair of fixing protrusions 611 is formed at the cover 61 corresponding to the recesses 605 for snappingly engaging with the recesses 605 thereby fixing the cover 61 to the base 60. A post 606 extends from the base 60 for engagingly extending into the assembled holes 22, 32, thereby fixing the buckle 6 to the left and the right goggle frame 2, 3. A shaft 64 is rotatably assembled between the upper and lower wall 601, 602 with end portions thereof received in the first axial hole 603.

The fastener 67, including an body 671, a handle 672 extending from the body 671, and an engagement protrusion 673 extending from the body 671 opposite the handle 672, is assembled between the upper and lower walls 601, 602 with end portions of the body 671 mounted on the second axial holes 604. The handle 672 is generally arc-shaped and the engagement protrusion 673 is generally barb-shaped. The body 671 is parallel and adjacent to the shaft 64. A tongue 674 integrally extends from a side of the handle 672 adjacent to the body 671 and can be leaned against the concavities 23(33) after assembly.

A chamber 63 is cooperatively defined in the base 60 and the cover 61 for receiving the shaft 64 and the fastener 67 therein. Also referring to FIG. 4, an entrance 65 is defined between the shaft 64 and the base 60 for extension of a free end 51 of the head strap 5. An exit 66 is defined between the shaft 64 and the cover 61 for providing the free end 51 of the head strap 5 passing through. A number of engagement slots 52 are defined in each free end 50, 51 of the head strap 5 for selectively engaging with the engagement protrusion 673 of the fastener 67 thereby fixing the head strap 5 to the buckle 6.

Referring to FIGS. 1 to 4, in assembly of the buckle 6, the shaft 64 and the fastener 67 are rotatably coupled to the first axial hole 603 and the second axial holes 604 of the base 60. The post 606 is received in the assembled hole 22 of the left goggle frame 2. The cover 61 is attached to the base 60 with the fixing protrusions 611 thereof engaging with the recesses 605 of the base 60. Thus, the buckle 6 is assembled to the left goggle frame 2. Likewise, the other buckle 6 is assembled to the right goggle frame 3.

Wrap the free ends 50, 51 of the head strap 5 respectively from the entrances 65 of the buckles 6 and over the shafts 64 and pass through the exits 66 of the buckles 6. Thereby one of the engagement slots 52 of each free end 50, 51 of the head strap 5 engages with the engagement portion 673 of the fastener 67. Thus, the head strap 5 is assembled to the buckles 6.

Figure 4:
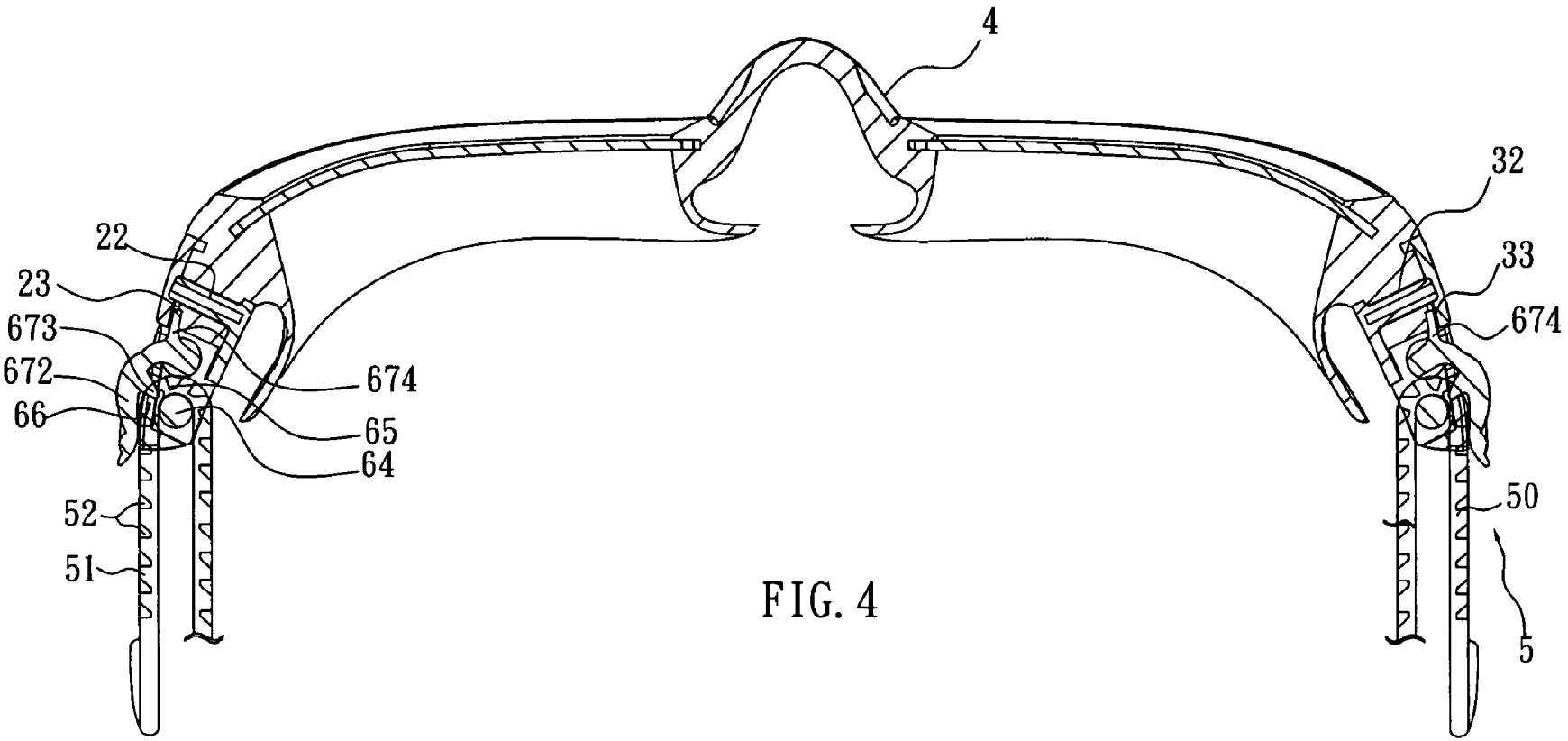
FIG. 4 is a cross-sectional view taken along line 4—4 in FIG. 3 and shows a head strap is engaged against the fastener.
Figure 5:
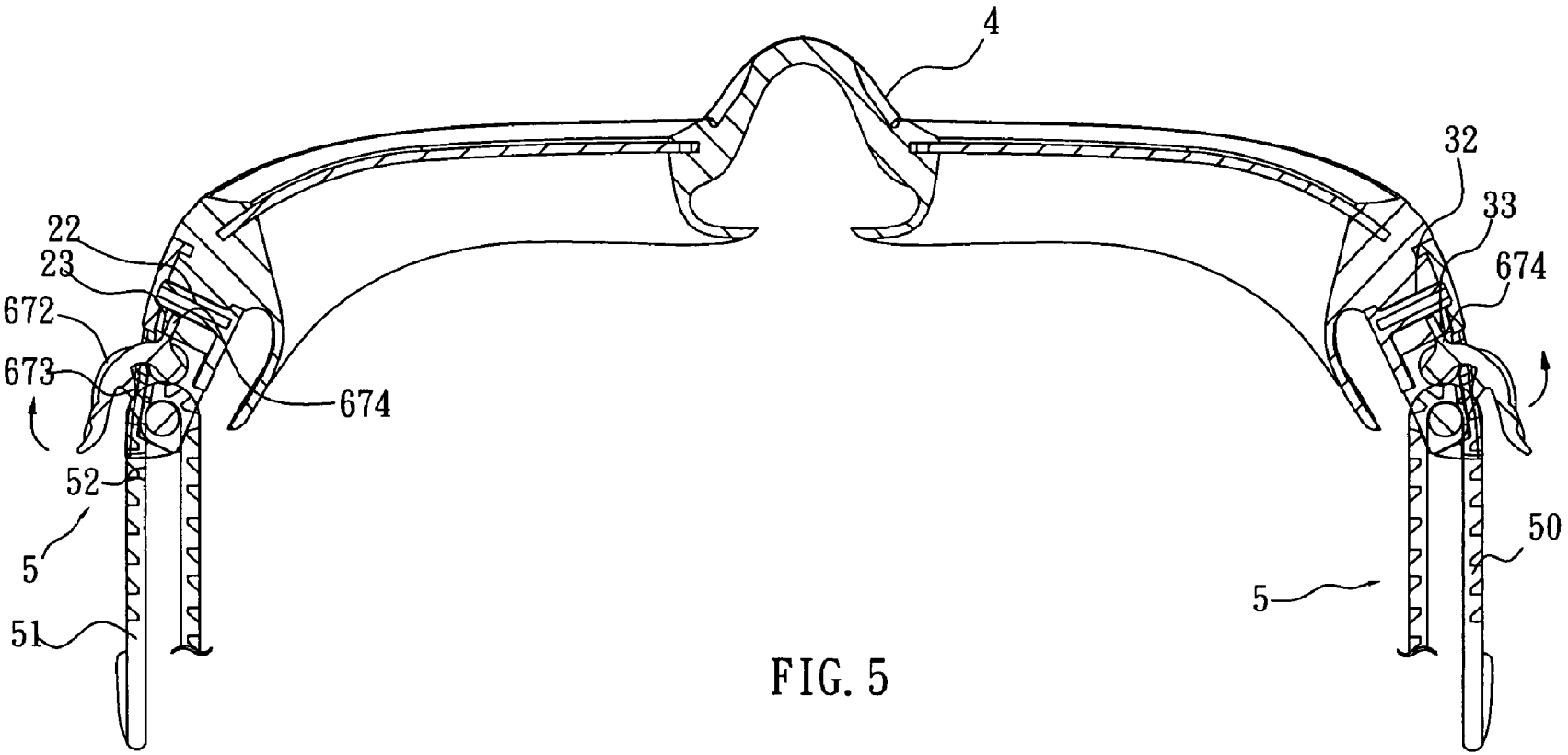
FIG. 5 is similar to FIG. 4 but showing the head strap is disengaged from the fastener.

Referring to FIGS. 4 and 5 showed an adjustment operation of wearing length of the head strap 5. In FIG. 4, the engagement protrusion 673 of the fastener 67 receivingly engages with one of the engagement slots 52 of the head strap 5, thus the head strap 5 is securely fixed to the buckle 6; in this condition the head strap 5 only can be tightened by drawing the free end 50, 51. In FIG. 5, the handle 672 of the fastener 67 is pushed outwardly to rotate the body 671 of the fastener 67 (shown as arrow), meanwhile, the tongue 674 thereby is pushed inwardly against the concavities 23, 33, and then the engagement protrusion 673 of the fastener 67 disengages from the engagement slot 52 of the head strap 5. Keep pushing the handle 672 outwardly and then move the swimming goggles 1 ahead of the user's eyes, thus the head strap 5 being loosened. When cease pushing the handle 672, the tongue 674 will return position automatically by resilience provided by quality of material of the concavities 23, 33. The engagement protrusion 673 receivingly engages with one of the engagement slots 52 of the head strap 5. Therefore, the swimming goggles 1 can be directly adjusted to meet size requirement of a user, when worn by the user. Furthermore, the swimming goggles 1 can be fittingly worn though once of adjustment. Accordingly, it is more convenient to use the swimming goggles 1 of the present invention.

It is understood that the invention may be embodied in other forms without departing from the spirit thereof. Thus, the present example and embodiment are to be considered in all respects as illustrative and not restrictive, and the invention is not to be limited to the details given herein.

The invention claimed is:

1. A pair of swimming goggles, comprising:

a left and a right goggle frame, each goggle frame having outer and inner surfaces, a receiving groove being defined between the outer and the inner surfaces of each goggle frame and receiving a lens therein, assembled holes respectively located on outer sides of the left and the right goggle frame;

a pair of buckles respectively fastened to the assembled holes, comprising: a base and a cover being engaged with the base, the base having a post for correspondingly mounting on the assembled holes, a chamber being cooperatively defined in the base and the cover and receiving a shaft and a fastener therein, an entrance being defined between the base and the shaft, an exit being defined between the shaft and the cover, the fastener having a body, a handle integrally extending from the body, and an engagement protrusion, a tongue integrally extending from a side of the body opposite to the handle; and a connection bridge connected between the left and the right goggle frames;

a head strap being coupled with the shaft of the base wherein a plurality of engagement slots being defined in each of the free ends of the head strap, each of the engagement slots being engagable with the engagement protrusion.

2. The swimming goggles as claimed in claim 1, each goggle frame has a concavity close to the assembled holes for providing a place for the tongue to lean against.

3. The swimming goggles as claimed in claim 2, wherein a pair of recesses is defined in the upper and lower walls of the base, a pair of fixing protrusions is formed at the cover and engages with the recesses of the base thereby fixing the cover to the base.

4. The swimming goggles as claimed in claim 1, wherein the tongue extends unitarily from the handle and toward the opposite direction thereof.

5. The swimming goggles as claimed in claim 4, wherein the base includes upper walls and lower walls, both having a first axial hole and a second axial hole for pivotally fixing the shaft and the fastener respectively.

6. The swimming goggles as claimed in claim 5, wherein the body of the fastener is in a shape of cylinder.

7. The swimming goggles as claimed in claim 6, wherein the handle is substantially arc-shaped for selectively adjusting the head strap.

8. The swimming goggles as claimed in claim 7, wherein the engagement protrusion protrudes from a side of the handle toward the shaft, and is substantially barb-shaped.

9. The swimming goggles as claimed in claim 1, wherein the connection bridge is integrally formed with the left and the right goggle frames.

10. The swimming goggles as claimed in claim 1, wherein a protection pad is respectively located at the inner surfaces of the left and the right goggle frames.

* * * * *